US007216615B2

(12) United States Patent
Takano

(10) Patent No.: US 7,216,615 B2
(45) Date of Patent: May 15, 2007

(54) ENGINE DEVICE FOR MOTORCYCLES

(75) Inventor: Yoshihide Takano, Shizuoka (JP)

(73) Assignee: Yamaha Hatsudoki Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 11/351,288

(22) Filed: Feb. 9, 2006

(65) Prior Publication Data

US 2006/0260582 A1 Nov. 23, 2006

(30) Foreign Application Priority Data

May 11, 2005 (JP) ..... 2005-139177

(51) Int. Cl.
*F02N 15/002* (2006.01)
*F02N 17/00* (2006.01)

(52) U.S. Cl. ..... 123/179.25

(58) Field of Classification Search ..... 123/179.25; 74/7 E

See application file for complete search history.

(56) References Cited

U.S. PATENT DOCUMENTS 4,848,170 A * 7/1989 Inagaki et al. ..... 74/6
6,305,337 B1 * 10/2001 Sumi et al. ..... 123/179.25
6,732,694 B2 * 5/2004 Holweg ..... 123/179.25
6,848,406 B2 * 2/2005 Ibukuro et al. ..... 123/179.25
7,131,412 B2 * 11/2006 Tsutsumi et al. ..... 123/179.25

FOREIGN PATENT DOCUMENTS

JP 06-341327 12/1994

* cited by examiner

*Primary Examiner*—Stephen K. Cronin
*Assistant Examiner*—Arnold Castro
(74) *Attorney, Agent, or Firm*—Hogan & Hartson LLP

(57) ABSTRACT

The present invention discloses an engine device for motorcycles in which a starter motor for transmitting drive force to a crankshaft through a reduction gear train can be disposed closer to the crankcase. The engine has a starter motor with a motor shaft, a crankshaft, and a reduction gear train for transmitting drive force of the starter motor to the crankshaft. The reduction gear train includes first gears supported for rotation on the first support shaft disposed parallel to the motor shaft of the starter motor, second gears supported on the second support shaft disposed parallel to the first support shaft, third gears supported on the generator shaft disposed parallel to the second support shaft, and a starter gear provided on the crankshaft disposed parallel to the generator shaft. The motor shaft of the starter motor is located closer to the generator shaft than the first support shaft.

8 Claims, 6 Drawing Sheets

ENGINE DEVICE FOR MOTORCYCLES

BACKGROUND OF THE INVENTION

1. Field of the Invention

The present invention relates to an engine device for motorcycles.

2. Description of Related Art

An engine device for motorcycles has been conventionally provided with a motor type starting device for starting an engine. The motor type starting device transmits drive force of the starter motor, for example, to a crankshaft through a reduction gear train housed in a side space within the crankcase (See Japanese Patent Document JP-A-Hei 6-341327, for example).

Such a reduction gear train is made up of a plurality of transmission gears each supported for rotation on a plurality of the respective support shafts disposed parallel to a motor shaft of the starter motor and the crankshaft.

Sometimes, however, a generator, which is usually provided integrally for rotation at the end of a crankshaft, is provided integrally for rotation at the end of a generator shaft disposed parallel to and offset from the crankshaft, depending on the layout of the vehicle body.

Therefore, some of transmission gears of the reduction gear train in the motor type starting device are configured such that they are supported on the generator shaft, but such a transmission gear is required to have an outside diameter greater than that of the rotor of the generator having a relatively large diameter.

Thus, the starter motor, which transmits drive force to the crankshaft through a reduction gear train having a relatively large outside diameter, is disposed at the upper part of the crankcase distant from the crankshaft. The starter motor has a strong influence on the weight balance of the vehicle in the longitudinal or the lateral direction because of its heavy weight and might cause a deviation of the weight balance because of its disposition distant from the crankshaft.

In addition, in the case where a V-type engine is provided with a motor type starting device, the starter motor can be disposed forward of the engine only at the upper part of the crankcase. In this case, the starter motor which is disposed away from the crankshaft, is disposed further forward of a cylinder block of the engine, and a running wind hitting against cooling fins might be blocked in an air-cooled engine.

SUMMARY OF THE INVENTION

Therefore, an object of the present invention is to provide a good engine device for motorcycles in which a starter motor for transmitting drive force to a crankshaft through a reduction gear train can be disposed closer to the crankcase in order to solve the foregoing problem.

The object of the present invention is achieved by an engine device for motorcycles comprising a starter motor having a motor shaft, a crankshaft, and an engine having a reduction gear train placed between the starter motor and the crankshaft for transmitting drive force of the starter motor to the crankshaft. The reduction gear train is provided with a first support shaft connected at one end to the motor shaft of the starter motor and at the other end to the crankshaft, and the motor shaft is located at a position closer to the crankshaft than the first support shaft.

According to the engine device for motorcycles described above, the power transmission path of a starter motor to the crankshaft can be reversed toward the crankshaft through a first support shaft of a reduction gear train. Thus, the starter motor can be disposed closer to the crankshaft.

In the foregoing engine device for motorcycles, it is preferable that the starter motor has a pinion gear disposed at the end of the motor shaft. The reduction gear train comprises a first support shaft disposed parallel to the motor shaft of the starter motor, first gears supported for rotation on the first support shaft; a second support shaft disposed parallel to the first support shaft, second gears supported for rotation on the second support shaft, and a starter gear provided on the crankshaft.

The first gears have a first gear meshing the pinion gear of the starter motor, and a second gear. The second gears have a third gear meshing the second gear, and a fourth gear connected to the crankshaft. The motor shaft is located at a position closer to the second support shaft than the first support shaft.

According to this arrangement, the power transmission path of the starter motor to a crankshaft can be reversed toward the crankshaft through first and second support shafts of a reduction gear train. Thus, the starter motor can be disposed closer to the second support shaft.

Further, in the foregoing engine device for motorcycles, it is preferable that the reduction gear train comprises a third support shaft disposed parallel to the second support shaft, third gears supported for rotation on the third support shaft, and a starter gear provided on the crankshaft disposed parallel to the third support shaft. The third gears have a fifth gear meshing the fourth gear, and a sixth gear meshing the starter gear on the crankshaft. The motor shaft is located closer to the third support shaft than the first support shaft.

According to this arrangement, the power transmission path of a starter motor to a crankshaft can be reversed toward the crankshaft through first to third support shafts of a reduction gear train. Thus, the starter motor can be disposed closer to the third support shaft.

Further, in the foregoing engine device for motorcycles, it is preferable that there is provided a torque limiter supported on the second support shaft, and the third gear is supported on the second support shaft through the torque limiter.

According to this arrangement, the starter motor can be protected at starting of the engine.

Further, in the foregoing engine device for motorcycles, it is preferable that there is provided a one-way clutch supported on the third support shaft, and the fifth gear is supported on the third support shaft through the one-way clutch.

According to this arrangement, although at starting of the engine, the one-way clutch can transmit drive force of a starter motor to the crankshaft, after the engine start, the one-way clutch does not transmit the rotation of the crankshaft to the starter motor, so that no reverse driving of the starter motor happens.

Further, in the foregoing engine device for motorcycles, it is preferable that the third support shaft is a generator shaft provided at one end with a generator.

According to this arrangement, even if a generator is provided integrally for rotation at the end portion of a generator shaft disposed parallel to and offset from the crankshaft, the starter motor can be disposed closer to the crankshaft.

Further, in the foregoing engine device for motorcycles, it is preferable that the starter motor is disposed further forward of the engine.

According to this arrangement, since the position of a starter motor disposed forward of the cylinder block of an air-cooled, V-type engine, for example, is lowered, the area required to hide cooling fins is reduced and no running wind hitting against the cooling fins of the cylinder block is blocked, providing a satisfactory engine cooling.

Further, in the foregoing engine device for motorcycles, it is preferable that there is provided a body frame having the engine mounted thereon, and the starter motor is disposed between cooling fins formed on the engine, and the generator.

According to this arrangement, since a starter motor is disposed between the body frame, the cooling fins of the engine, and the generator, mounting space of the vehicle body can be utilized effectively.

According to the foregoing engine device for motorcycles, the power transmission path of a starter motor to the crankshaft can be reversed toward the crankshaft through a reduction gear train and the starter motor can be disposed closer to the crankshaft. Thus, deviation of the weight balance of the engine device due to the heavy weight of the starter motor can be reduced.

Further, since the position of a starter motor disposed forward of the engine at the upper part of the crankcase can be lowered, the area required to hide cooling fins of an air-cooled engine is reduced, which improves the cooling property of the engine.

DETAILED DESCRIPTION OF THE INVENTION

Now, a preferred embodiment of the engine device for motorcycles according to the present invention is described below in detail with reference to the accompanying drawings.

Figure 1:
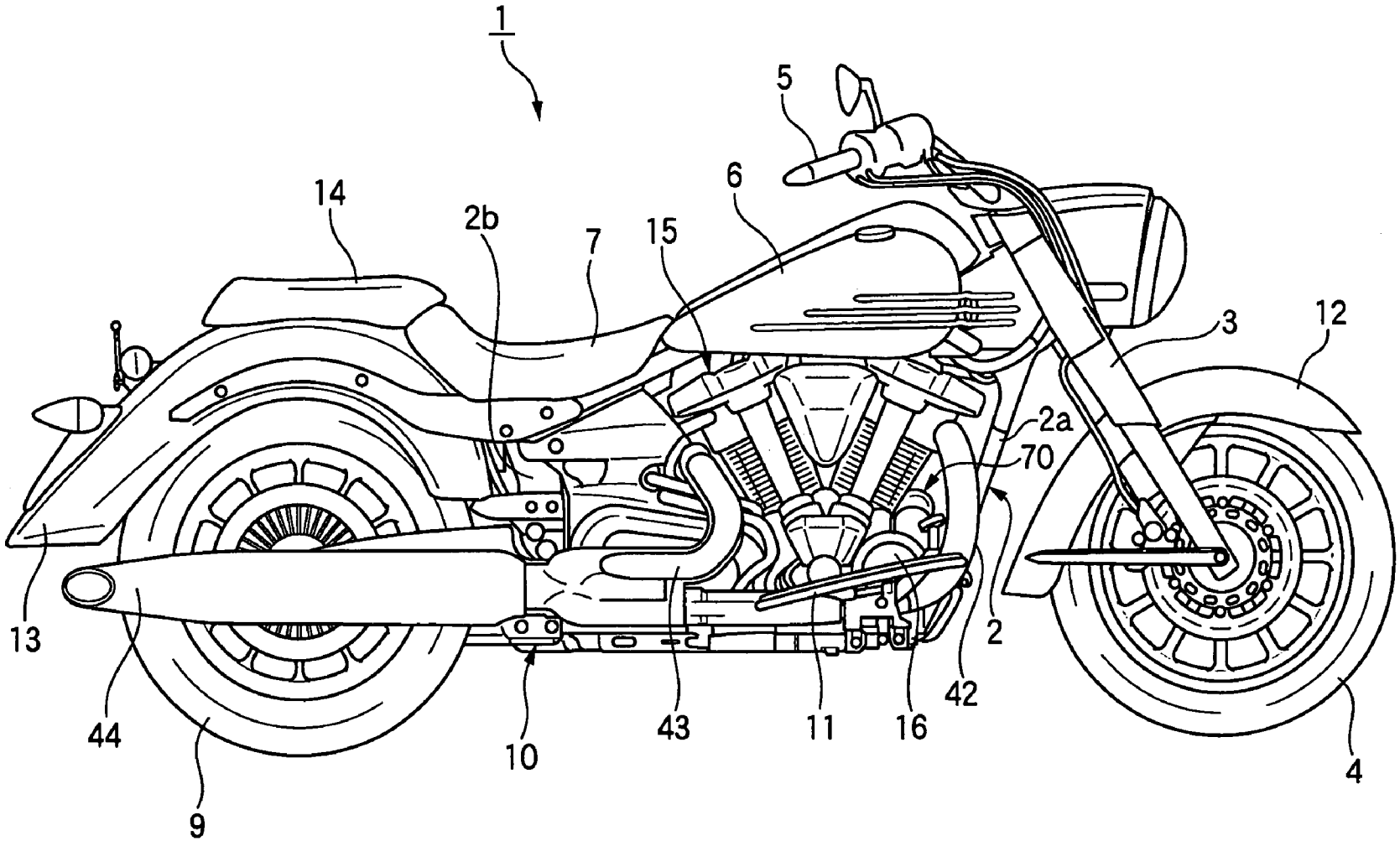
FIG. 1 is a right side view of a motorcycle having an engine device for motorcycles according to the present invention mounted thereon.
Figure 2:
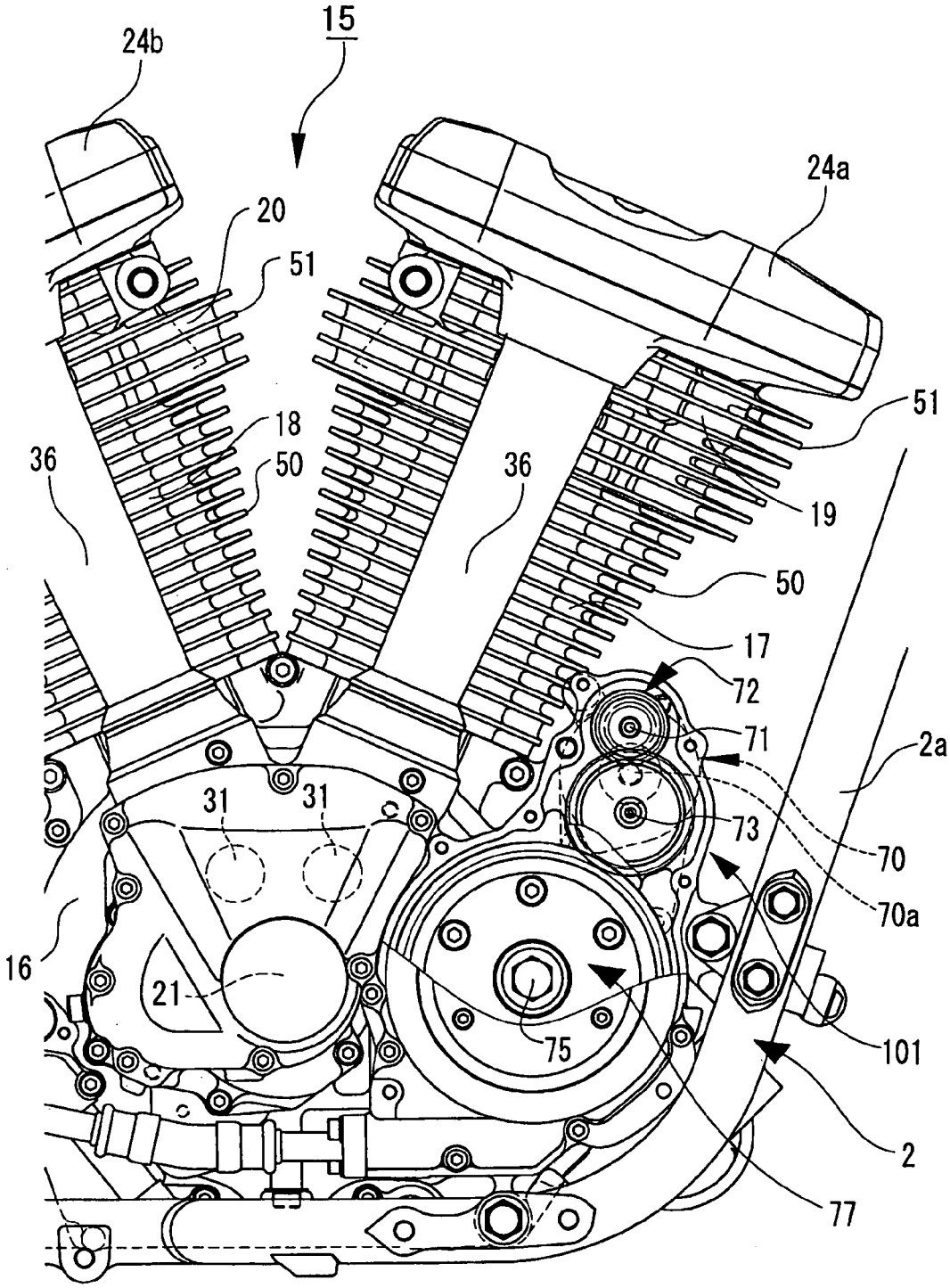
FIG. 2 is an enlarged right side view of a portion of the engine device for motorcycles shown in FIG. 1.
Figure 3:
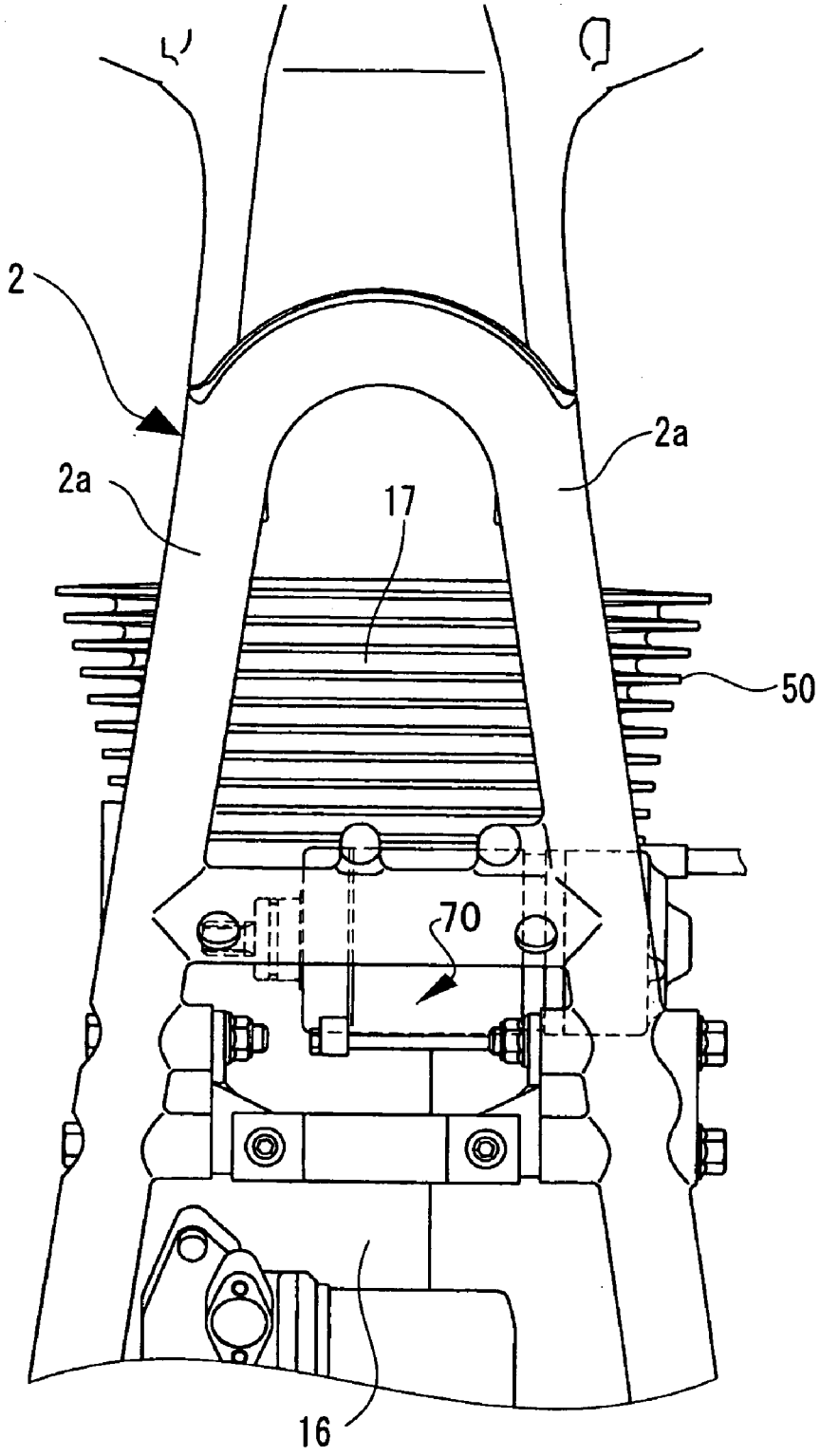
FIG. 3 is an enlarged front view of a portion of the engine device for motorcycles shown in FIG. 1.
Figure 4:
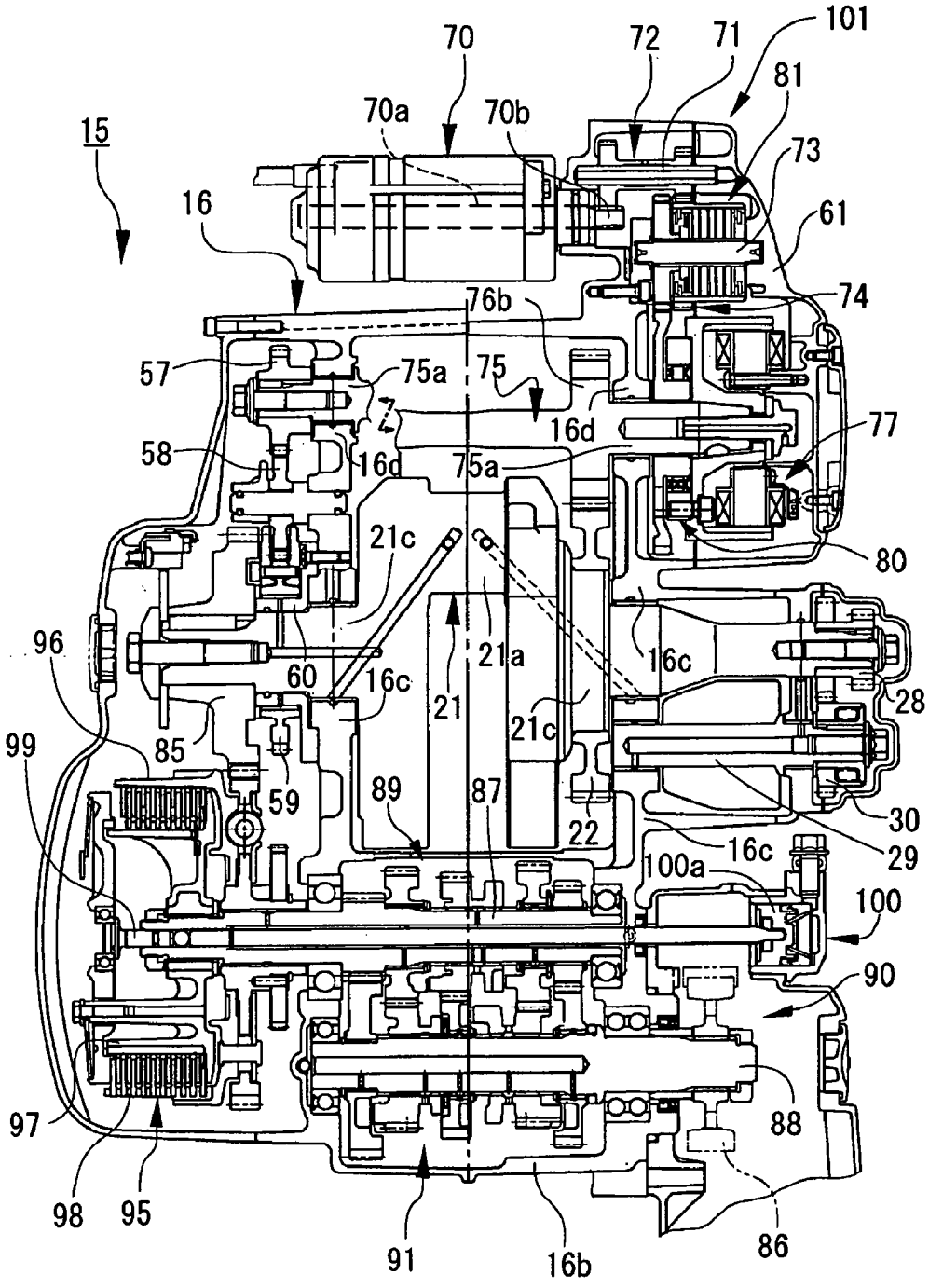
FIG. 4 is a sectional plan view of the engine device for motorcycles shown in FIG. 1.
Figure 5:
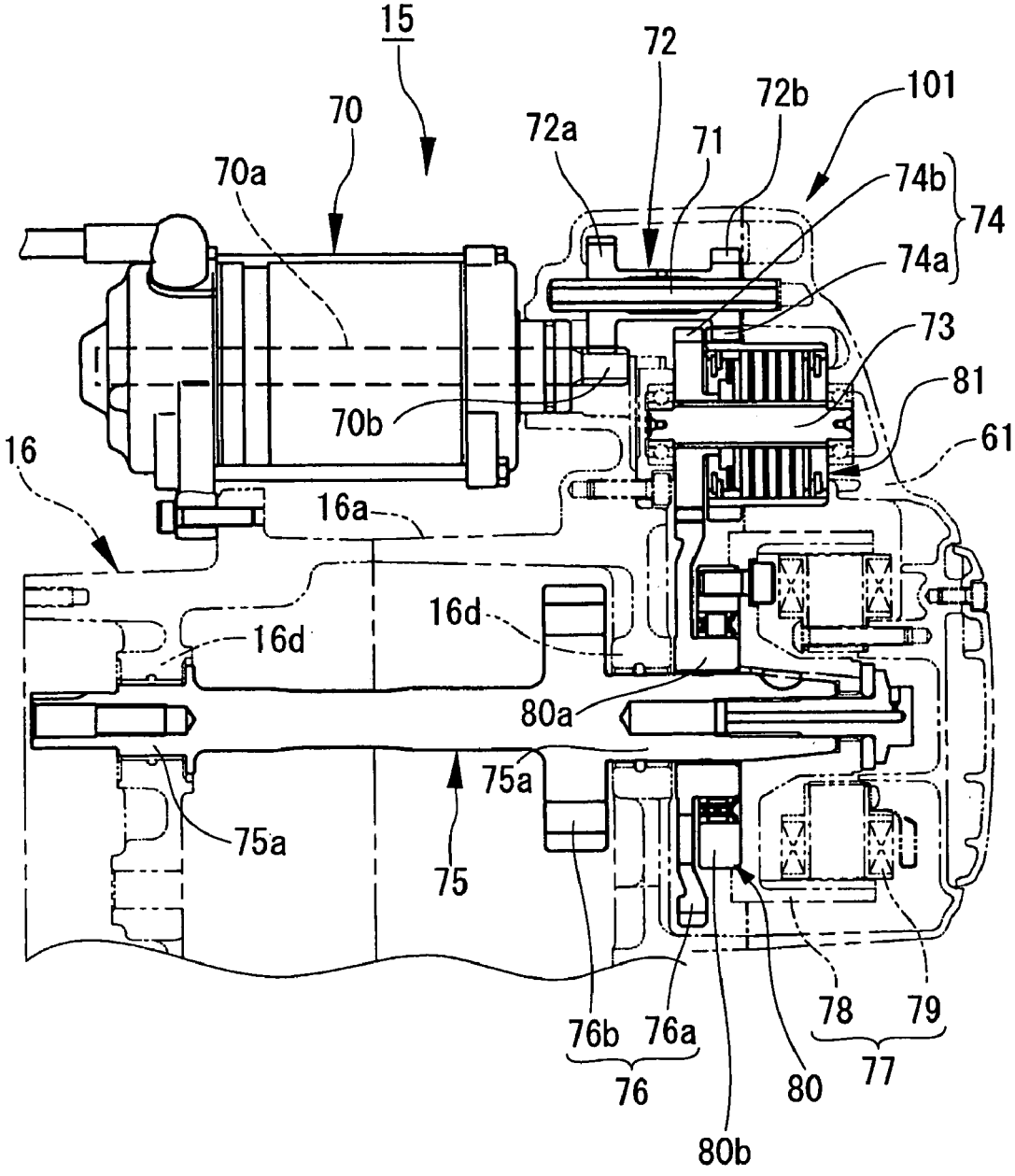
FIG. 5 is an enlarged sectional plan view of a portion of the engine device for motorcycles shown in FIG. 4.
Figure 6:
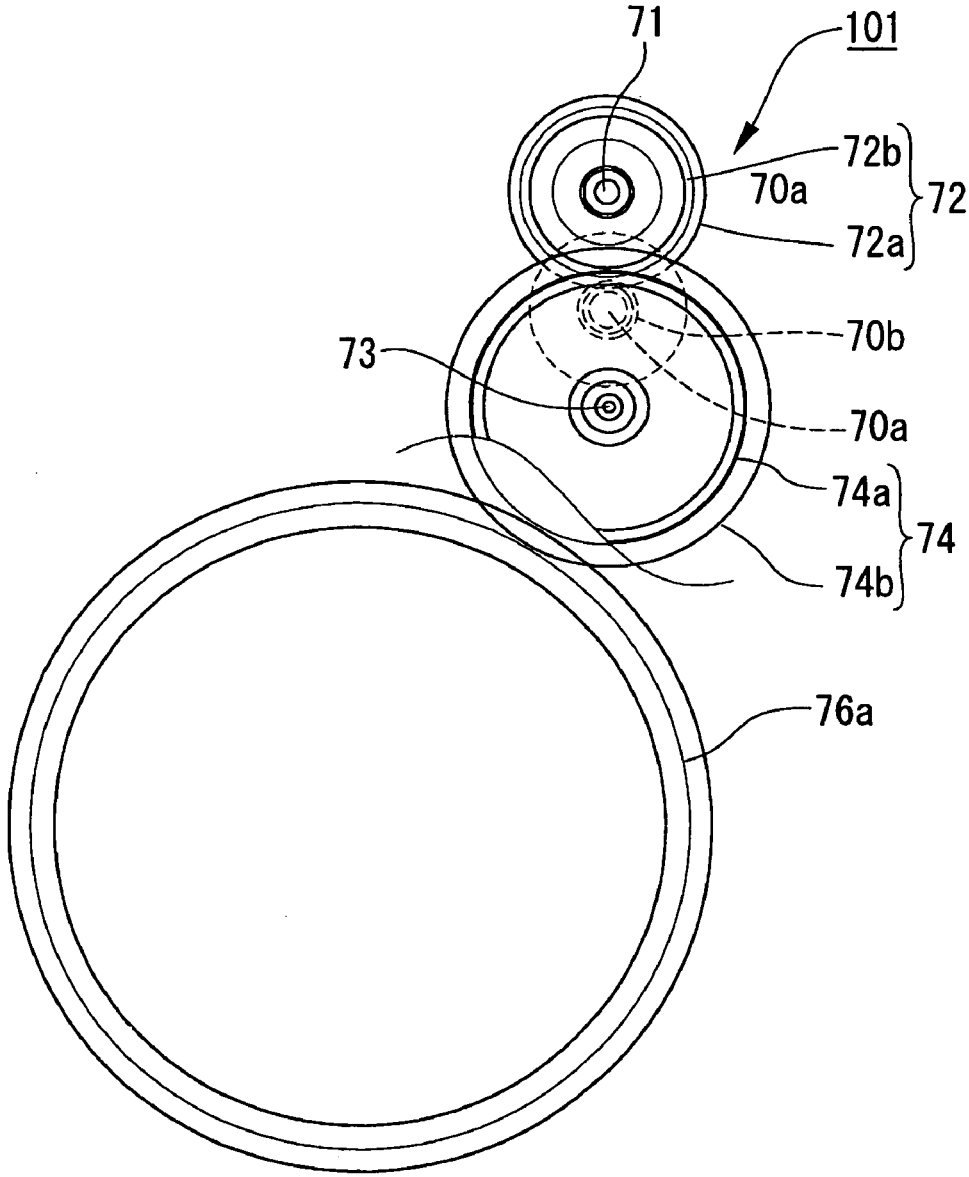
FIG. 6 is a schematic right side view showing an arrangement of a reduction gear train shown in FIG. 2.

FIG. 1 is a right side view of a motorcycle on which an engine device for motorcycles according to the present invention is mounted. FIG. 2 is an enlarged right side view of a portion of the engine device for motorcycles shown in FIG. 1. FIG. 3 is an enlarged front view of a portion of the engine device for motorcycles shown in FIG. 1. FIG. 4 is a sectional plan view of the engine device for motorcycles shown in FIG. 1. FIG. 5 is an enlarged sectional plan view of a portion of the engine device for motorcycles shown in FIG. 4. FIG. 6 is a schematic right side view showing an arrangement of the reduction gear train shown in FIG. 2.

A motorcycle 1, as shown in FIG. 1, is a cruiser type motorcycle. This motorcycle 1 has a structure schematically described below.

A front fork 3 is supported for rotation by a head pipe (not shown) fixed to the forward end of a body frame 2 of double cradle type. A front wheel 4 is supported at the lower end of the front fork 3, while handlebars 5 are disposed at the upper end thereof.

A fuel tank 6 and a seat 7 are disposed at the upper part of the body frame 2, and further a rear wheel 9 is supported at the rear end of a rear arm 8 pivotally mounted for up and down swinging movement to a rear arm bracket 2*b* of the body frame 2.

A rear suspension 10 is disposed between the rear arm 8 and body frame 2. A footrest board 11 for supporting the driver's foot is disposed at each side of left and right down tubes 2*a* of the body frame 2.

A front fender 12 for covering the upper side of the front wheel 4 is mounted to the front fork 3. A rear fender 13 for covering approximately the upper half of the rear wheel 9 is mounted on a rear frame (not shown) extending rearward from the upper end of the rear arm bracket 2*b*, and a rear seat 14 is provided on the upper surface of the rear fender 13.

As shown in FIG. 2, the engine device for motorcycles according to this embodiment includes a starter motor 70 having a motor shaft 70*a*, a crankshaft 21, and an engine 15 having a reduction gear train 101 placed between the starter motor 70 and crankshaft 21 for transmitting drive force of the starter motor 70 to the crankshaft 21.

The engine 15 is an air-cooled, four-stroke, V-type two-cylinder, OHV engine, which is mounted inside the cradle of the body frame 2.

The engine 15 has a structure schematically described below.

A forward cylinder block 7 and a rear cylinder block 18 are disposed longitudinally of the vehicle such that they make a given bank angle to each other. A forward cylinder head 19 and a rear cylinder head 20 are placed on the upper mating surfaces of the forward and rear cylinder blocks 17, 18 in tiers, respectively, to be fastened with head bolts. Further, head covers 24*a*, 24*b* are mounted on the upper mating surfaces of the cylinder heads 19, 20.

On the outside circumferential walls of the forward and rear cylinder blocks 17, 18 and the forward and rear cylinder heads 19, 20 are integrally formed numerous cooling fins 50, 51 approximately at right angles to the bore axes. Because of a running wind directly hitting against the cylinder blocks 17, 18 and the cylinder heads 19, 20, heat from the engine is radiated through the cooling fins 50, 51, thereby cooling the engine 15.

The crankcase 16 has a structure in which a crankcase section 16*a* containing the crankshaft 21 and a mission case section 16*b* containing a transmission mechanism 90 (described later) are formed integrally, as shown in FIG. 4.

The crankshaft 21 is disposed horizontally in the lateral direction of the vehicle and set so as to rotate clockwise as viewed from the right side of the vehicle. The crankshaft 21 has a crank pin 21*a* common to the forward and rear cylinders, left and right crank webs 21*b*, 21*b* and left and right crank journals 21*c*, 21*c*.

In each cylinder bore of the forward and rear cylinder blocks 17, 18 is inserted a piston (not shown) for sliding movement, and the piston is connected to a crank pin 21*a* of the crankshaft 21 common to the forward and rear cylinders through a connecting rod.

An intake valve opening and an exhaust valve opening formed in the forward and the rear cylinder head 19, 20 are opened and closed by an intake and an exhaust valve (not shown). Specifically, a forward and a rear camshaft 31, 31 are driven for rotation by the crankshaft 21 to advance and retract an intake and an exhaust push rod (not shown) in up and down direction and then rotate an intake and an exhaust rocker arm (not shown) for opening and closing the openings.

The camshafts 31, 31 are disposed, in the crankcase 16, parallel to the crankshaft 21 and driven for rotation through an intermediate shaft 29 and a timing gear 30 by a drive gear 28 fixed to the right end portion of the crankshaft 21.

The intake and the exhaust pushrods are housed in cylindrical casings 36, 36 disposed to be exposed to the right side, along the cylinder axes of the forward and rear cylinder blocks 17, 18, respectively.

Each exhaust valve opening of the forward and rear cylinder heads 19, 20 leads to the outside wall of the V-bank through a joint exhaust port. To The forward and rear exhaust ports are connected forward and rear exhaust pipes 42, 43, as shown in FIG. 1. The exhaust pipes 42, 43 extend rearward on the right side of the vehicle body to be joined together, to the downstream end of which is connected a muffler 44 disposed at the right side of the rear wheel 9.

The transmission mechanism 90 is disposed in the transmission case section 16*b* of the crankcase 16, and configured such that a main shaft 87 having an import gear group 89. A drive shaft 88, having an output gear group 91 meshing the import gear group 89, are each disposed parallel to the crankshaft 21.

When a foot-operated shift lever is controlled in a rocking manner, a shift drum (not shown) is rotated and shift forks move in the axial directions to connect any specified gears of the import gear group 89 and output gear group 91 to the main shaft 87 and drive shaft 88, so that switching is performed between lowest speed and highest speed stages.

The right end portion of the drive shaft 88 is protruded outwardly from the transmission case section 16*b*, and a drive sprocket 86 mounted on the protruded drive shaft 88 is coupled with a follower sprocket located at one end of a drive shaft (not shown) disposed in the transfer case through a chain. Further, a belt pulley provided at the other end of the drive shaft is coupled with a follower pulley of the rear wheel 9 through a drive belt.

The main shaft 87 is provided, at the left end thereof, with a clutch mechanism 95. The clutch mechanism 95 has a structure in which numerous clutch plates 98 are disposed between an outer drum 96 mounted for relative rotation on the main shaft 87 and an inner drum 97 connected to the main shaft 87 for rotation therewith. The clutch mechanism 95 is adapted to transmit or cut off engine power to the main shaft 87 when a push rod 99 inserted in the axial center of the main shaft 87 is advanced/retracted by an oil piston 100*a* of an oil cylinder member 100.

The crankshaft 21 has the left and the right crank journal 21*c* supported by bosses 16*c* formed on a left and a right sidewall of the crankcase section 16*a*. A crank gear 85 is fixed by key-engagement to the left end portion of the crankshaft 21 with a second balancer gear 59 placed between the crank gear 85 and the boss.

Further, forwardly of the crankshaft 21 is disposed, parallel to the crankshaft 21, a generator shaft 75 having a generator 77 mounted thereon at the right end. The generator 77 includes a rotor 78 fitted on the generator shaft 75 at the right end and rotating together in one body and a coil assembly 78 supported fixedly on a starter gear cover 61.

The generator shaft 75 has a transmission gear (sixth gear) 76*b* meshing the starter gear 22 provided on the crankshaft 21. A first balancer gear 57 mounted at the left end of the generator shaft 75 engages with the second balancer gear 59 through an intermediate gear 58. The second balancer gear 59 is supported for rotation on a balancer housing 60 fixed to the crankcase section 16*a* of the crankcase 16.

In this arrangement, the first balancer gear 57 rotates in the opposite direction at a speed twice as fast as the crankshaft 21, and the second balancer gear 59 rotates in the opposite direction at the same speed as the crankshaft 21.

Further, the engine 15 according to this embodiment has a reduction gear train 101 that is placed between a starter motor 70 disposed at the upper part of the crankcase 16 and the crankshaft 21 and transmits drive force of the starter motor 70 to the crankshaft 21, as shown in FIGS. 2 and 3.

As shown in FIGS. 4 and 5, a starter gear cover 61 is mounted fluid-tightly on the right side of the crankcase section 16*a* of the crankcase 16 and there is provided a starter gear chamber separate from the crankcase section 16*a*.

In the starter gear chamber, a reduction gear train 101 is housed to transmit drive force of the starter motor 70 to the crankshaft 21.

The reduction gear train 101 of this embodiment includes a first support shaft 71 disposed parallel to the motor shaft 70*a* of the starter motor 70. First gears 72 are supported for rotation on the first support shaft 71. A second support shaft 73 is disposed parallel to the first support shaft 71. Second gears 74 are supported for rotation on the second support shaft 73. A generator shaft (third support shaft) 75 is disposed parallel to the second support shaft 73. Third gears 76 are supported for rotation on the generator shaft 75. A starter gear 22 is disposed on the crankshaft 21 and parallel to the generator shaft 75.

The first support shaft 71, one side of which is connected to the motor shaft 70*a* and the other side of which is connected to the crankshaft 21, has one end supported for fitting on the crankcase 16 and the other end supported for fitting on the starter gear cover 61.

The second support shaft 73 is supported, at both ends, for rotation on the crankcase 16 and starter gear cover 61 through bearings.

The generator shaft 75 has a left and a right journal 75*a*, 75*a* supported by bosses 16*d* formed on the left and the right wall of the crankcase section 16*a*.

The first gears 72 are formed integrally of a large first gear 72*a* meshing a pinion gear 70*b* disposed at one end of the motor shaft 70*a*, and a small second gear 72*b* meshing a third gear 74*a* of the second gears 74.

The second gears 74 have a third gear 74*a* supported on the second support shaft 73 through a torque limiter 81, and a fourth gear 74*b* meshing a fifth gear 76*a* of the third gears 76 and rotating with the second support shaft 73 in one body.

The third gears 76 have a fifth gear 76*a* supported on the generator shaft 75 through a one-way clutch 80, and a transmission gear (sixth gear) 76*b* meshing the starter gear 22. The starter motor 70 has the motor shaft 70*a* located closer to the generator shaft 75 than the first support shaft 71, as shown in FIG. 6.

That is, the starter motor 70 is disposed between the down tubes 2*a* of the body frame 2 located forwardly of the engine 15, the cooling fins 50 formed on the engine 15, and the generator 77, as shown in FIGS. 2 and 3.

In the motor type starting device having a reduction gear train 101 as described above, when starter motor 70 is energized to rotate the pinion gear 70*b* starting of the engine, the rotation is transmitted to the third gear 74*a* of the second gears 74 through the first gears 72. Then, the rotation transmitted to the third gear 74*a* is transmitted to the second support shaft 73 through the torque limiter 81, for the rotation of the fourth gear 74*b*.

When the fourth gear 74*b* rotates, the rotation is transmitted to the fifth gear 76*a*. Then, an inner ring 80*a* of the one-way clutch 80 rotates with the fifth gear 76*a*, and in turn an outer ring 80*b* rotates in the same direction to rotate the rotor 78 and generator shaft 75 of the generator 77.

When the generator shaft 75 rotates, the rotation is transmitted to the starter gear 22 through the transmission gear 76*b*, for the rotation of the crankshaft 21. In this way, rotary motion of the crankshaft 21 causes the engine 15 to start.

That is, according to the engine 15 of the engine device of this embodiment described above, driving force of the starter motor 70 can be transmitted to the crankshaft 21 through the first gear 72*a* and second gear 72*b* of the first gears 72 supported for rotation on the first support shaft 71 disposed at a position more distant than the motor shaft 70*a* of the starter motor 70.

Therefore, the power transmission path of the starter motor 70 to the crankshaft 21 can be reversed toward the crankshaft 21 through the first support shaft 71 of the reduction gear train 101, and the starter motor 70 can be disposed closer to the crankshaft 21.

As a result, deviation of the weight balance of the engine 15 due to the heavy weight of the starter motor 70 can be decreased.

Further, if a generator 77 is provided integrally for rotation at the end portion of the generator shaft 75 disposed parallel to and offset from the crankshaft 21, as in the engine 15, the fifth gear 76*a* supported on the generator shaft 75 is required to have an outside diameter larger than that of the rotor 78 of the generator 77 having a relatively large diameter, and the second support shaft 73 should be correspondingly disposed further away from the crankshaft 21.

However, since in the engine 15 of this embodiment, the starter motor 70 can be disposed closer to the crankshaft 21, as described above, the influence on the weight balance of the vehicle in the longitudinal or the lateral direction can be reduced when the generator shaft 75 is disposed parallel to and offset from the crankshaft 21. Further, in the engine 15 of this embodiment, the starter motor 70 can be disposed closer also to the second support shaft 73 and generator shaft 75.

In addition, since the third gear 74*a* of this embodiment is supported on the second support shaft 73 through the torque limiter 81, the starter motor 70 can be protected at starting of the engine.

Further, the fifth gear 76*a* of this embodiment is supported on the generator shaft 75 through the one-way clutch 80. Therefore, at starting of the engine, the one-way clutch 80 can transmit the drive force of the starter motor 70 to the crankshaft 21, but after the engine start, since the one-way clutch 80 does not transmit the rotation of the crankshaft 21 toward the starter motor 70, no reverse driving of the starter motor happens.

In addition, since the engine 15 of this embodiment is an air-cooled, V-type two-cylinder engine, the starter motor 70 disposed at the upper part of the crankcase 16, is disposed further forward of the forward cylinder block 17. However, as shown in FIGS. 2 and 3, the starter motor 70 can be provided at a lower position, so that the area required to hide the cooling fins 50 is reduced and running wind hitting against the cooling fins 50 of the forward cylinder block 17 is not blocked, which provides a satisfactory engine cooling.

Further, the mounting space of the vehicle body can be utilized effectively since the starter motor 70 is disposed between the cooling fins 50 of the engine 15, the generator 77, and the down tube 2*a* of the body frame 2 located forwardly of the engine 15.

It should be understood that the configuration of the starter motor, first to third support shafts, first to third gears, first to sixth gears, torque limiter, one-way clutch, generator, and engine type or the like, is not limited to that of the foregoing embodiment, but various modes can be adopted, based on the spirits of the present invention.

For example, although in the foregoing embodiment, the third gear 74*a* of the second gears 74 is supported on the second support shaft 73 through the torque limiter 81, the second gear can be formed of integrated third and forth gears.

Further, although in the foregoing embodiment, the fifth gear 76*a* of the third gear 76 is supported on the generator shaft 75 through the one-way clutch 80, a structure is possible in which the fifth gear is fixed to the generator shaft 75 and the starter gear is supported on the crankshaft through the one-way clutch.

The invention claimed is:

1. An engine device for motorcycles comprising:

a starter motor having a motor shaft;

a crankshaft; and an engine having a reduction gear train placed between the starter motor and the crankshaft for transmitting drive force of the starter motor to the crankshaft, wherein the reduction gear train is provided with a first support shaft connected at one end to the motor shaft of the starter motor and at the other end to the crankshaft, and wherein the motor shaft is located at a position closer to the crankshaft than the first support shaft.

2. The engine device for motorcycles according to claim 1, wherein the starter motor has a pinion gear disposed at the end of the motor shaft;

the reduction gear train comprises a first support shaft disposed parallel to the motor shaft of the starter motor, first gears supported for rotation on the first support shaft, a second support shaft disposed parallel to the first support shaft, second gears supported for rotation on the second support shaft, and a starter gear provided on the crankshaft;

the first gears have a first gear meshing the pinion gear of the starter motor, and a second gear;

the second gears have a third gear meshing the second gear, and a fourth gear connected to the crankshaft; and the motor shaft is located at a position closer to the second support shaft than the first support shaft.

3. The engine device for motorcycles according to claim 2, wherein the reduction gear train comprises a third support shaft disposed parallel to the second support shaft, third gears supported for rotation on the third support shaft, and a starter gear provided on the crankshaft disposed parallel to the third support shaft;

the third gears have a fifth gear meshing the fourth gear, and a sixth gear meshing the starter gear on the crankshaft; and the motor shaft is located closer to the third support shaft than the first support shaft.

4. The engine device for motorcycles according to claim 2, wherein there is provided a torque limiter supported on the second support shaft, and wherein the third gear is supported on the second support shaft through the torque limiter.

5. The engine device for motorcycles according to claim 3, wherein there is provided a one-way clutch supported on the third support shaft, and wherein the fifth gear is supported on the third support shaft through the one-way clutch.

6. The engine device for motorcycles according to claim 3, wherein the third support shaft is a generator shaft provided at one end with a generator.

7. The engine device for motorcycles according to claim 1, wherein the starter motor is disposed further forward of the engine.

8. The engine device for motorcycles according to claim 7, wherein there is provided a body frame having the engine mounted thereon, and the starter motor is disposed between cooling fins formed on the engine, and the generator.

* * * * *